US010189062B2

(12) United States Patent
Li

(10) Patent No.: US 10,189,062 B2
(45) Date of Patent: Jan. 29, 2019

(54) COMPENSATION METHOD FOR ASYMMETRIC PLATE PROFILE OF PLATE/STRIP ROLLING MILL

(71) Applicant: Huifeng Li, Taiyuan (CN)

(72) Inventor: Huifeng Li, Taiyuan (CN)

( * ) Notice: Subject to any disclaimer, the term of this patent is extended or adjusted under 35 U.S.C. 154(b) by 0 days.

(21) Appl. No.: 15/551,286

(22) PCT Filed: Feb. 1, 2016

(86) PCT No.: PCT/CN2016/000067
§ 371 (c)(1),
(2) Date: Aug. 16, 2017

(87) PCT Pub. No.: WO2016/145928
PCT Pub. Date: Sep. 22, 2016

(65) Prior Publication Data

US 2018/0029095 A1 Feb. 1, 2018

(30) Foreign Application Priority Data

Mar. 13, 2015 (CN) ..... 2015 1 0109417
Jun. 2, 2015 (CN) ..... 2015 1 0292890

(51) Int. Cl.
*B21B 37/30* (2006.01)
*B21B 27/02* (2006.01)

(52) U.S. Cl.
CPC ..... *B21B 37/30* (2013.01); *B21B 27/02* (2013.01); *B21B 27/021* (2013.01)

(58) Field of Classification Search
CPC ..... B21B 27/021; B21B 27/028; B21B 27/02; B21B 37/28; B21B 37/30
See application file for complete search history.

(56) References Cited

U.S. PATENT DOCUMENTS

2008/0000281 A1* 1/2008 Klockner ..... B21B 13/142 72/241.8
2008/0163659 A1* 7/2008 Huang ..... B21B 27/021 72/14.8
2011/0289996 A1* 12/2011 Seidel ..... B21B 13/142 72/241.2

FOREIGN PATENT DOCUMENTS

| | | | |
|---|---|---|---|
| CN | 87103686 | A | 12/1987 |
| CN | 1276273 | A | 12/2000 |
| CN | 101683657 | A | 3/2010 |
| CN | 101554635 | B | 1/2011 |
| CN | 102009067 | B | 5/2012 |
| CN | 102256715 | B | 2/2014 |
| CN | 102699040 | B | 4/2014 |

(Continued)

*Primary Examiner* — Debra Sullivan
(74) *Attorney, Agent, or Firm* — Gokalp Bayramoglu

(57) ABSTRACT

A compensation method of an asymmetric strip shape of a strip rolling mill, for compensating the asymmetric strip shape of a strip caused in a machining process of the strip rolling mill in the prior art. The compensation method is realized by generating a non-linear asymmetric no-load roll-shaped profile curve through polishing an upper working roll and a lower working roll of a rolling mill and forming a non-linear asymmetric no-load roll gap between a transmission side and a working side of the upper and lower working rolls. The strip rolling mill in the prior art refers to a presently commonly used two-roll rolling mill driven by the transmission side of the working roll, a four-roll rolling mill equipped with a support roll and a multi-roll rolling mill equipped with a middle roll.

4 Claims, 1 Drawing Sheet

(56) References Cited

FOREIGN PATENT DOCUMENTS

| | | | |
|---|---|---|---|
| CN | 104722585 | A | 6/2015 |
| CN | 104985005 | A | 10/2015 |
| CN | 100333845 | C | 8/2017 |
| WO | WO0119544 | A1 | 3/2001 |

* cited by examiner

COMPENSATION METHOD FOR ASYMMETRIC PLATE PROFILE OF PLATE/STRIP ROLLING MILL

CROSS REFERENCE TO RELATED APPLICATIONS

This application is a national phase application of PCT/CN2016/000067 filed on Feb. 1, 2016, which claims priority to Chinese application CN201510109417.6 filed on Mar. 13, 2015 and Chinese application CN201510292890.2 filed on Jun. 2, 2015, the entire contents of which are incorporated herein by reference.

TECHNICAL FIELD

The present invention relates to the field of metal rolling and is used for compensating the asymmetric plate profile produced by the plate/strip rolling mill to improve the quality of plate profile of plate/strip products.

BACKGROUND OF THE INVENTION

Currently, the general plate/strip rolling mill refers to a two-roll mill driven by a work roll at transmission side, a four-roll mill configured with the supporting roll, and a multi-roll mill configured with the middle roll. In order to improve the plate profile of the processed metal plate/strip, a Chinese Patent Application with the No. 200980151893.7 discloses a plate profile adjustment method of Continuously Variable Convexity Curve (CVC), PC rolling mill technology for crossing the work rolls, and roll profile grinding heat convexity compensation curve, etc., which have been developed and used in the prior art. However, the above all methods implement the profile control or improvement on the basis that the transmission side is symmetric with respect to the operation side of the rolling mill but do not affect the asymmetric plate profile produced by the processing of metal plate/strip.

In order to improve the asymmetric plate profile produced by the processing of the metal plate/strip by the rolling mill, the bending roller method, in which the bending moment is applied to the work roll of the rolling mill, has been developed and used in the prior art. Certain effects have been achieved. However, the bending roller failed to effectively deal with the defects of asymmetric plate profile caused by the processing of the plate/strip and the problems of quality control and production stability thereof.

SUMMARY OF THE INVENTION

The technical problem to be solved by the invention is to provide a compensation method for asymmetric plate profile of plate/strip rolling mill to overcome the drawbacks of the currently available plate/strip rolling mill. By grinding the work roll of the rolling mill, with specific roll contour curve, the non-linear asymmetric no-load roll gap of the transmission side and the operation side are formed between the upper work roll and the lower work roll to compensate and control the asymmetric plate profile produced by the processing of the metal plate/strip, so that the defects of asymmetric plate profile resulting from machining the plate/stripe under current technical conditions and the dominant and potential quality issues resulted from the asymmetric plate profile can be reduced or eliminated. Moreover, the failures related to production stability such as center-deviation, tail flick, pack rolling and the like, which are caused during the production process of the plate/strip rolling mill due to the asymmetric plate profile, can be reduced.

In order to achieve the above objectives, the technical solution used by the present invention is as below. A compensation method for asymmetric plate profile of plate/strip rolling mill is provided, with the non-linear asymmetric no-load roll contour profile curve of the upper work roll and lower work roll of the rolling mill, the non-linear asymmetric no-load roll gap of the transmission side and the operation side are formed between the upper work roll and the lower work roll.

The height of non-linear asymmetric no-load roll gap between the upper work roll and the lower work roll forms a non-linear asymmetric no-load roll gap height curve.

The non-linear asymmetric no-load roll gap height curve includes a polynomial equation which is cubic or has a higher degree. In the polynomial equation, the axial coordinate of the roll is used as the variable and the coefficient of the highest odd-ordered term is not zero. The polynomial equation can be described by formula (1) as follows:

$$\mathrm{Gap}(x)=\mathrm{Gap}_0+G_1\cdot x^1+G_2\cdot x^2+G_3\cdot x^3+\ldots+G_n\cdot x^n \quad (1)$$

wherein, $\mathrm{Gap}_0$ is a set value of a roll gap with the center of the roll body as the origin of the coordinate system;

$G_1$, $G_2$, $G_3$, . . . $G_n$ are the coefficients of the polynomial equation (the values range from −1 to 1);

x is the coordinate of the roll body of the work roll in the axial direction with the center of the roll body as the origin of the coordinate system;

n is selected as any value not less than 3. As the value of n increases, the accuracy of compensating the plate profile is improved. However, the difficulty of calculation is increased significantly.

The non-linear asymmetric no-load roll contour profile curve is a polynomial equation which is cubic or has a higher degree corresponding to the formula of the non-linear asymmetric no-load roll gap height curve. In the formula, the axial coordinate of the roll is used as the variable. The non-linear asymmetric no-load roll contour profile curve is obtained by grinding at least one of the upper work roll and the lower work roll.

The non-linear asymmetric no-load roll gap includes an undifferentiated degree of asymmetry between the upper work roll and the lower work roll. The no-load roll gap formed between the upper work roll and the lower work roll is up-down symmetric and non-linear asymmetric between the transmission side and the operation side. The asymmetric no-load roll gap includes a differentiated degree of asymmetry between the upper work roll and the lower work roll, and grinding merely one of the two work rolls of the rolling mill with the non-linear asymmetric roll contour profile curve. The no-load roll gap formed between the upper work roll and the lower work roll is up-down asymmetric and asymmetric between the transmission side and the operation side.

A simple and practical method to implement and achieve the intended object of the present invention is to describe the non-linear asymmetric no-load roll contour profile curve as a one-variable cubic polynomial like formula (2) and (6), and describe the non-linear asymmetric roll gap formed between the upper work roll and the lower work roll as a one-variable cubic polynomial like formula (7). The specific implementation process conforms to the following description:

(1) The lower profile curve of the upper work roll with respect to a center line of the roll is described by the formula (2) as follows:

$$S_{WU}(x)=A_3\cdot x^3+A_2\cdot x^2+A_1\cdot x-A_0 \quad (2)$$

wherein, x is the coordinate of the roll body of the work roll in the axial direction with the center of the roll body as the origin of the coordinate system;

$A_0$ is the radius of the roll body with the center of the roll body of the work roll as the origin of the coordinate system;

$A_1$ is the linear asymmetric parameter of the roll contour profile curve of the work roll, and the value of $A_1$ can be determined by formula (3):

$$A_1=K_1+K_2\cdot Bp+K_3\cdot Br+K_4\cdot Br/Bp+K_5/R^3+K_6\cdot Tq \quad (3)$$

wherein, Bp is the width of the rolled piece with the unit of meter,

Br is the length of the work roll surface with the unit of meter;

R is the nominal radius of the work roll with the unit of meter;

Tq is the on-load average torque of the work roll with the unit of KN·m;

$K_1$, $K_2$, $K_3$, $K_4$, $K_5$ and $K_6$ are the adjustment parameters, and the adjustment parameters range from −1 to 1;

$A_2$ is the symmetry parameter of the roll contour profile curve of the work roll, and the value of $A_2$ can be determined by the formula (4):

$$A_2=M_1+M_2\cdot Bp+M_3\cdot Br+M_4\cdot Br/Bp+M_5/R^3+M_6\cdot Tq \quad (4)$$

wherein, Bp is the width of the rolled piece with the unit of meter;

Br is the length of the roll body of the work roll with the unit of meter;

R is the nominal radius of the work roll with the unit of meter;

Tq is the on-load average torque of the work roll with the unit of KN·m;

$M_1$, $M_2$, $M_3$, $M_4$, $M_5$ and $M_6$ are the adjustment parameters, the value of the adjustment parameters ranges from −1 to 1;

$A_3$ is the non-linear asymmetric parameter of the roll contour profile curve of the work roll, and the value of $A_3$ can be determined by formula (5):

$$A_3=N_1+N_2\cdot Bp+N_3\cdot Br+N_4\cdot Br/Bp+N_5/R^3+N_6\cdot Tq \quad (5)$$

wherein,

Bp is the width of the rolled piece with the unit of meter,

Br is the length of the roll body of the work roll with the unit of meter;

R is the nominal radius of the work roll with the unit of meter;

Tq is the on-load average torque of the work roll with the unit of KN·m;

$N_1$, $N_2$, $N_3$, $N_4$, $N_5$ and $N_6$ are the adjustment parameters, the value of the adjustment parameters ranges from −1 to 1;

(2) Similarly, the upper profile curve of the lower work roll with respect to the center line of the roll is described by formula (6) as follows:

$$S_{WD}(x)=-B_3\cdot x^3-B_2\cdot x^2-B_1\cdot x+B_0 \quad (6)$$

wherein, the conditions of $B_3$, $B_2$, $B_1$, $B_0$ are the same as described above.

(3) The lower profile roll contour curve of the upper work roll and the upper profile roll contour curve of the lower work roll of the rolling mill are superposed in a coordinate system to obtain the no-load roll gap height curve formula (7) of the upper work roll and the lower work roll as follows:

$$\mathrm{Gap}(x)=(A_3+B_3)\cdot x^3+(A_2+B_2)\cdot x^2+(A_1+B_1)\cdot x+\mathrm{Gap}_0 \quad (7)$$

wherein, x is the coordinate of the roll body of the work roll in the axial direction with the center of the roll body as the origin of the coordinate system;

$\mathrm{Gap}_0$ is a set value of a roll gap with the center of the roll body as the origin of the coordinate system;

The no-load roll gap height curve includes a linear asymmetric portion and an asymmetric portion having non-linearity. The linear asymmetric portion of the no-load roll gap height curve is achieved by work roll grinding, or by using the method of single-sided screw-down adjustment during the rolling process, or by asymmetric screw-down on the transmission side and operation side of the rolling mill.

The asymmetric portion having non-linearity of the no-load roll gap height curve is realized by grinding the work roll with a non-linear asymmetric roll contour curve.

The non-linear asymmetric no-load roll contour curve and the no-load roll gap curve of the plate/strip rolling mill can be applied separately on a rolling mill.

The non-linear asymmetric no-load roll contour profile curve is superimposed on the currently used roll thermal convexity compensation curve, continuously variable convexity curve, and/or other roll contour profile curves of the rolling mill to form a new asymmetric no-load roll contour profile curve and roll gap curve for application.

The newly generated no-load roll gap height curve between the upper work roll and lower work roll satisfies the following formula:

$$\mathrm{Gap}(x)=(A_3+B_3)\cdot x^3+(A_2+B_2)\cdot x^2+(A_1+B_1)\cdot x+\mathrm{Gap}_0+f_u(x)-f_d(x) \quad (8)$$

Wherein $f_u(x)$ and $f_d(x)$ are the roll contour profile curve functions of the upper work roll and the lower work roll of the plate/strip rolling mill currently used.

No matter how the roll thermal convexity compensation curve, the continuously variable convexity curve, and/or other roll contour profile curves are superimposed with the non-linear asymmetric no-load roll contour profile curve the characteristic of non-linear asymmetry of the no-load roll gap curve would not be changed.

The present invention has at least the following advantages:

The present invention provides a method for compensating and controlling the asymmetric plate profile of the plate/strip rolling mill, which is fundamentally different from the plate profile control technology of the existing plate/strip rolling mill. The essential differences are that the present invention provides the measures to form an asymmetric no-load roll gap height curve of the transmission side and the operation side between the upper work roll and the lower work roll to improve the quality of the asymmetric plate profile of the plate/strip rolling mill. No matter which kind of symmetric or asymmetric roll profile curve is used in the existing plate profile control technology, the solution is designed to follow the principle that the transmission side and the operation side of the roll gap height curve are symmetric with each other.

The present invention can effectively deal with the defects of asymmetric plate profile resulted from machining the plate/strip by the plate/strip rolling mill and the problems of the quality control and production stability caused thereby under the current technical conditions.

Figure 1:
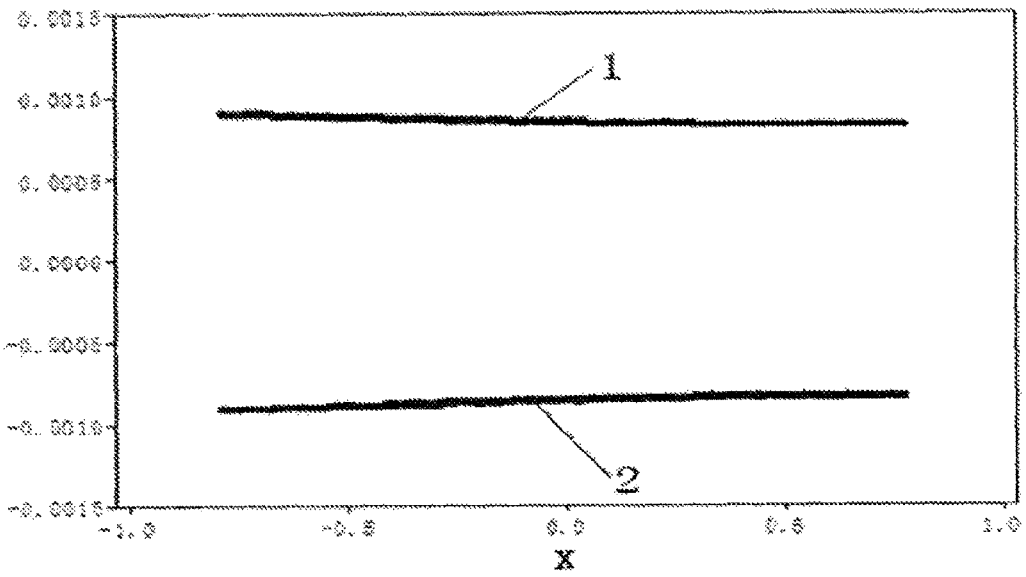
FIG. 1 is a diagram showing the lower profile curve of the upper work roll and the upper profile roll contour curve of the lower work roll of the present invention in a coordinate system.

In the drawings, 1 is the lower profile curve of the upper work roll of the rolling mill, 2 is the upper profile roll contour curve of the lower work roll, 3 is the straight line that indicates the maximum value of the no-load roll gap, 4 is the line that connects the maximum value and the minimum value of the no-load roll gap, 5 is the height curve of the no-load roll gap.

DETAILED DESCRIPTION OF THE INVENTION

In order to fully understand the objectives, features, and functions of the present invention, the present invention will be described in detail with reference to the following embodiments. However, the present invention is not limited hereto.

The present invention provides a compensation method for asymmetric plate profile of plate/strip rolling mill. The work roll profile is grinded with a specific curve to obtain an asymmetric set roll gap of the transmission side and the operation side between the upper work roll and the lower work roll. The asymmetric plate profile produced by the processing of the metal plate/strip is compensated and controlled, such that a series of problems, i.e., deviation, tail flick, asymmetric plate profile, etc., during the rolling process can be avoided.

The asymmetric plate profile mentioned in the present invention refers to the common phenomenon of asymmetric distribution of the thickness of the left and right sides of the plate/strip and the asymmetric waves of the plate/strip (or potential waves) during the rolling process of the plate/strip by the rolling mill under the current technical conditions.

The deviation mentioned in the present invention refers to the phenomenon where the rolled piece is curved toward the operation side or the transmission side of the rolling mill with respect to the rolling center line during the rolling process.

The tail flick mentioned in the present invention refers to the phenomenon where during the rolling process after the tail portion of the rolled plate goes out of the rolling mill, the rolled plate cannot move normally, thereby causing swings and jumps. The rolled plate under this condition enters the next machine, which results in the tail portion of the rolled plate being folded, broken, etc.

The compensation method for the asymmetric plate profile of the plate/strip rolling mill of the present invention will be described in detail hereafter.

A compensation method for asymmetric plate profile of plate/strip rolling mill is provided. At least one of the upper work roll and the lower work roll of the rolling mill is grinded with a non-linear asymmetric roll contour curve, so that a non-linear asymmetric roll gap height curve of the transmission side and the operation side is formed between the upper work roll and the lower work roll.

The non-linear asymmetric no-load roll contour profile curve is a polynomial cubic formula or a polynomial formula of higher degree using the axial coordinate of the roll as the variable. The non-linear asymmetric no-load roll gap height curve formed between the upper work roll and the lower work roll is also a polynomial cubic formula or a polynomial formula of higher degree using the axial coordinate of the roll as the variable.

A simple and practical method to implement and achieve the intended object of the present invention is to describe the non-linear asymmetric no-load roll contour profile curve as a one-variable cubic polynomial like formula (1) and (5), and describe the non-linear asymmetric roll gap formed between the upper work roll and the lower work roll as a one-variable cubic polynomial like formula (6). The specific implementation process conforms to the following description:

(1) The lower profile curve of the upper work roll with respect to a center line of the roll is described by the formula (1) as follows:

$$S_{WU}(x)=A_3\cdot x^3+A_2\cdot x^2+A_1\cdot x[[-]]+A_0 \quad (1)$$

wherein, x is the coordinate of the roll body of the work roll in the axial direction with the center of the roll body as the origin of the coordinate system;

$A_0$ is the radius of the roll body with the center of the roll body of the work roll as the origin of the coordinate system;

$A_1$ is the linear asymmetric parameter of the roll contour profile curve of the work roll. The value of $A_1$ can be determined by formula (2):

$$A_1=K_1+K_2\cdot Bp+K_3\cdot Br+K_4\cdot Br/Bp+K_5/R^3+K_6\cdot Tq \quad (2)$$

wherein,

Bp is the width of the rolled piece with the unit of meter;

Br is the length of the work roll surface with the unit of meter,

R is the nominal radius of the work roll with the unit of meter,

Tq is the on-load average torque of the work roll with the unit of KN−m;

$K_1$, $K_2$, $K_3$, $K_4$, $K_5$, and $K_6$ are the adjustment parameters, and the adjustment parameters range from −1 to 1;

$A_2$ is the symmetry parameter of the roll contour profile curve of the work roll, and the value of $A_2$ the can be determined by the formula (3):

$$A_2=M_1+M_2\cdot Bp+M_3\cdot Br+M_4\cdot Br/Bp+M_5/R^3+M_6\cdot Tq \quad (3)$$

wherein,

Bp is the width of the rolled piece with the unit of meter;

Br is the length of the roll body of the work roll with the unit of meter;

R is the nominal radius of the work roll with the unit of meter,

Tq is the on-load average torque of the work roll with the unit of KN·m;

$M_1$, $M_2$, $M_3$, $M_4$, $M_5$, and $M_6$ are the adjustment parameters, the value of the adjustment parameters ranges from −1 to 1;

$A_3$ is the non-linear asymmetric parameter of the roll contour profile curve of the work roll, and the value of $A_3$ can be determined by formula (4):

$$A_3=N_1+N_2\cdot Bp+N_3\cdot Br+N_4\cdot Br/Bp+N_5/R^3+N_6\cdot Tq \quad (4)$$

wherein,

Bp is the width of the rolled piece with the unit of meter;

Br is the length of the roll body of the work roll with the unit of meter;

R is the nominal radius of the work roll with the unit of meter,

Tq is the on-load average torque of the work roll with the unit of KN·m;

$N_1$, $N_2$, $N_3$, $N_4$, $N_5$, and $N_6$ are the adjustment parameters, the value of the adjustment parameters ranges from −1 to 1;

(2) Similarly, the upper profile curve of the lower work roll with respect to the center line of the roll is described by formula (5) as follows:

$$S_{WD}(x)=-B_3\cdot x^3-B_2\cdot x^2-B_1\cdot x+B_0 \quad (5)$$

wherein, the conditions of $B_3$, $B_2$, $B_1$, $B_0$ are the same as described above.

(3) With the upper work roll and the lower work roll of the rolling mill mounted on the corresponding positions of the same rolling mill, the formula (6) of the no-load roll gap height curve between the upper work roll and the lower work roll is obtained and described as follows:

$$\mathrm{Gap}(x)=(A_3-B_3)\cdot x^3+(A_2-B_2)\cdot x^2+(A_1-B_1)\cdot x+\mathrm{Gap}_0 \quad (6)$$

wherein, x is the coordinate of the roll body of the work roll in the axial direction with the center of the roll body as the origin of the coordinate system;

$\mathrm{Gap}_0$ is a set value of a roll gap with the center of the roll body as the origin of the coordinate system.

The benefits of the present invention as described above can be achieved using the rolling mill assembled by the above-mentioned work rolls to produce the plate/strip under the corresponding conditions.

Figure 2:
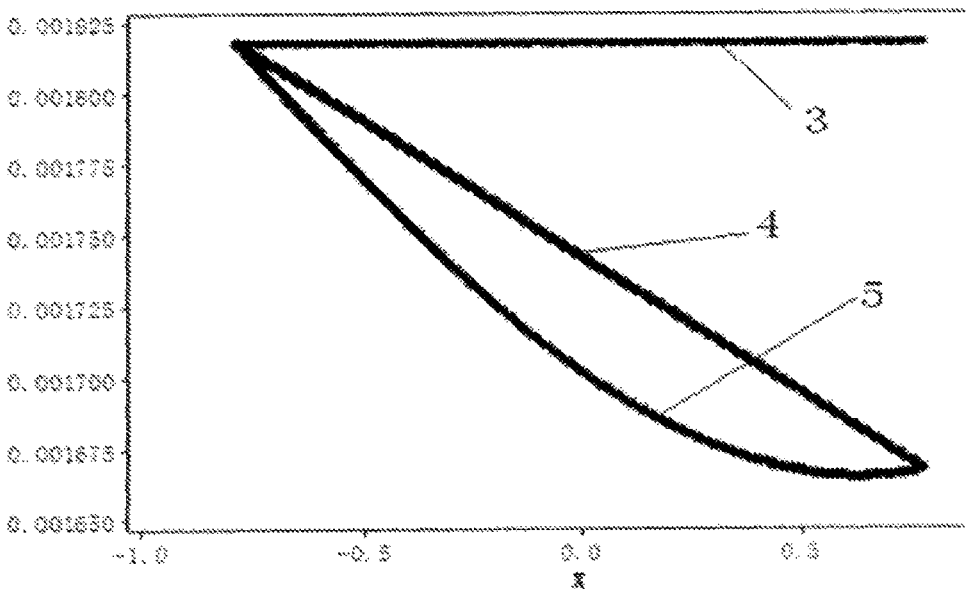
FIG. 2 is an exploded view of the roll gap height set curve of the present invention.

As shown in FIG. 2, the no-load roll gap height curve 5 includes a linearly asymmetric portion and an asymmetric portion having a non-linear curve. The linearly asymmetric portion is formed between straight line 3 which indicates the maximum value of the roll gap and line 4 which connects the maximum value and minimum value of the no-load roll gap. The asymmetric portion having a non-linear curve is formed between line 4 which connects the maximum value and the minimum value of the roll gap and the no-load roll gap height curve 5. Moreover, the linearly asymmetric portion can be achieved by the work roll grinding. The linearly asymmetric portion can also be achieved by a method of single-sided screw-down adjustment during the rolling process, or be achieved by the asymmetric screw-down on both sides of the rolling mill.

Moreover, the non-linear asymmetric portion is compensated using the work roll grinding asymmetric curve and under the above-mentioned conditions of the present invention.

When the two work rolls of the rolling mill are grinded with the asymmetric curves, the degree of asymmetry between the upper work roll and the lower work roll can be undifferentiated or differentiated. One of the work rolls of the rolling mill can be grinded with the asymmetric curve to achieve the asymmetry of the overall roll gap between the upper work roll and the lower work roll without difference.

The compensation method for asymmetric plate profile of the plate/strip rolling mill of the present invention can be applied independently on the rolling mill or superposed with the roll thermal convexity compensation curve and the continuously variable convexity curve (with the Chinese patent application number 200980151893.7) to produce a new rolling mill non-linear work roll no-load profile curve to be applied to the rolling mill. However, no matter how the superposition is carried out, the characteristic of non-linear asymmetry of the no-load roll gap height curve between the upper work roll and the lower work roll of the rolling mill would not be changed.

What is claimed is:

1. A compensation method for an asymmetric plate profile of a plate/strip rolling mill for compensating an asymmetric profile produced in the plate/strip rolling comprising:

grinding a non-linear asymmetric no-load roll contour profile curve on at least one of an upper work roll and a lower work roll of the rolling mill to obtain a non-linear asymmetric no-load roll gap asymmetric at a transmission side and an operation side between the upper work roll and the lower work roll; wherein a non-linear asymmetric no-load roll gap height curve of the non-linear asymmetric no-load roll gap formed between the upper work roll and the lower work roll is expressed by a first three or higher order polynomial equation, a first axial coordinate of a first centerline between the upper work roll and the lower work roll is used as a first variable of the first three or higher order polynomial equation, and a coefficient of a highest odd-ordered term of the first three or higher order polynomial equation is not zero, the first three or higher order polynomial equation is described by equation (1) as below:

$$\mathrm{Gap}(x)=\mathrm{Gap}_0+G_1\cdot x^1+G_2\cdot x+G_3x^3+\ldots+G_n\cdot x^n \quad (1)$$

wherein, x is the first axial coordinate of the first centerline between the upper work roll and the lower work roll with a first center of the first centerline as a first origin of a first coordinate system;

$\mathrm{Gap}_0$ is a set value of a roll gap between the upper work roll and the lower work roll at the center of the first centerline between the upper work roll and the lower work roll;

$G_1$, $G_2$, $G_3$, . . . $G_n$ are coefficients of the first three or higher order polynomial equation, and each of $G_1$, $G_2$, $G_3$, . . . $G_n$ ranges from −1 to 1; and n is no less than 3.

2. The compensation method for an asymmetric plate profile of a plate/strip rolling mill according to claim 1, wherein, the non-linear asymmetric no-load roll contour profile curve comprises a first non-linear asymmetric no-load roll contour profile curve and a second non-linear asymmetric no-load roll contour profile curve;

the upper work roll is grinded with the first non-linear asymmetric no-load roll contour profile curve and the lower work roll is grinded with the second non-linear asymmetric no-load roll contour profile curve, the first non-linear asymmetric no-load roll contour profile curve is expressed by a lower contour profile curve of the upper work roll with respect to a second centerline of the upper work roll and is described by the formula (2) as follows:

$$S_{WU}(x)=A_3\cdot x^3+A_2\cdot x^2+A_1\cdot x-A_0 \quad (2)$$

wherein, x is a second axial coordinate of an upper work roll body with a second center of the upper work roll body as a second origin of a second coordinate system;

$A_0$ is a nominal radius of the upper work roll body at the second center of the upper work roll body;

$A_1$ is a linear asymmetric parameter of the lower contour profile curve of the upper work roll, and a value of $A_1$ can be determined by formula (3):

$$A_1=K_1+K_2\cdot Bp+K_3\cdot Br+K_4\cdot Br/Bp+K_5/R^3+K_6\cdot Tq \quad (3)$$

wherein,

Bp is a width of a rolled piece with a unit of meter;

Br is a length of a surface of the upper work roll with the unit of meter;

R is a nominal radius of the upper work roll with the unit of meter

Tq is an on-load average torque of the upper work roll with the unit of KN·m:

$K_1$, $K_2$, $K_3$, $K_4$, $K_5$, and $K_6$ are adjustment parameters, and each of the adjustment parameters ranges from −1 to 1;

$A_2$ is a symmetry parameter of the lower contour profile curve of the upper work roll, and a value of $A_2$ can be determined by the formula (4):

$$A_2=M_1+M_2\cdot Bp+M_3\cdot Br+M_4\cdot Br/Bp+M_5/R^3+M_6\cdot Tq \quad (4)$$

wherein, $M_1$, $M_2$, $M_3$, $M_4$, $M_5$, and $M_6$ are adjustment parameters, and each of the adjustment parameters ranges from −1 to 1;

$A_3$ is a non-linear asymmetric parameter of the lower contour profile curve of the upper work roll, and a value of $A_3$ can be determined by formula (5):

$$A_3=N_1+N_2\cdot Bp+N_3\cdot Br+N_4\cdot Br/Bp+N_5/R^3+N_6\cdot Tq \quad (5)$$

wherein, $N_1$, $N_2$, $N_3$, $N_4$, $N_5$, and $N_6$ are adjustment parameters, and each of the adjustment parameters ranges from −1 to 1;

the second non-linear asymmetric no-load roll contour profile curve is expressed by an upper profile curve of the lower work roll with respect to a third centerline of the lower work roll and is described by formula (6) as follows:

$$S_{WD}(x)=-B_3\cdot x^3-B_2\cdot x^2-B_1\cdot x+B_0 \quad (6)$$

wherein, x is a third axial coordinate of a lower work roll body with a third center of the lower work roll body as a third origin of a third coordinate system;

$B_0$ is a nominal radius of the lower work roll body;

$B_1$ is a linear asymmetric parameter of the upper contour profile curve of the lower work roll, and a value of $B_1$ can be determined by the following formula:

$$B_1=K_1+K_2\cdot Bp+K_3Br+K_4\cdot Br/Bp+K_5/R^3+K_6\cdot Tq$$

$B_2$ is a symmetry parameter of the upper contour profile curve of the lower work roll, and a value of $B_2$ can be determined by the following formula:

$$B_2=M_1+M_2\cdot Bp+M_3\cdot Br+M_4\cdot Br/Bp+M_5/R^3+M_6\cdot Tq$$

$B_3$ is a non-linear asymmetric parameter of the upper contour profile curve of the lower work roll, and a value of $B_3$ can be determined by the following formula:

$$B_3=N_1+N_2\cdot Bp+N_3\cdot Br+N_4\cdot Br/Bp+N_5/R^3+N_6\cdot Tq$$

the lower profile roll contour curve of the upper work roll and the upper profile roll contour curve of the lower work roll of the rolling mill are superposed in the first coordinate system to obtain a no-load roll gap height superposing curve formula (7) of the upper work roll and the lower work roll as follows:

$$\mathrm{Gap}(x)=(A_3+B_3)\cdot x^3+(A_2+B_2)\cdot x^2+(A_1+B_1)\cdot x+\mathrm{Gap}_0 \quad (7)$$

wherein, x is the axial coordinate of the first centerline between the upper work roll and the lower work roll with the first center of the first centerline between the upper work roll and the lower work roll as the first origin of the first coordinate system-and ($A_3$+$B_3$) is a coefficient of a highest odd-ordered term of the formula (7) and is not zero.

3. The compensation method for an asymmetric plate profile of a plate/strip rolling mill of claim 1, wherein, the non-linear asymmetric no-load roll gap height curve is applied to the rolling mill via grinding the upper work roll or the lower work roll, or both of them with the non-linear asymmetric no-load roll contour profile curve without superimposing with other roll contour profile curves.

4. The compensation method for an asymmetric plate profile of a plate/strip rolling mill of claim 1, wherein, the non-linear asymmetric no-load roll gap height curve is applied to the rolling mill, via grinding the upper work roll or the lower work roll, or both of them with the non-linear asymmetric no-load roll contour profile curve superimposed with other roll contour profile curves.

* * * * *